US008013877B2

(12) United States Patent
Ou-Yang et al.

(10) Patent No.: US 8,013,877 B2
(45) Date of Patent: Sep. 6, 2011

(54) METHOD AND DEVICE OF RAPIDLY GENERATING A GRAY-LEVEL VERSUS BRIGHTNESS CURVE OF A DISPLAY

(75) Inventors: Mang Ou-Yang, Taipei Hsien (TW); Shih-Wei Huang, Taipei Hsien (TW); Jiun-Chian Liao, Taipei Hsien (TW); Gordon Horng, Taipei Hsien (TW); Tsang-Hsing Lee, Taipei Hsien (TW); Yih-Shyang Chen, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 1085 days.

(21) Appl. No.: 11/826,407

(22) Filed: Jul. 16, 2007

(65) Prior Publication Data

US 2008/0143752 A1 Jun. 19, 2008

(30) Foreign Application Priority Data

Dec. 18, 2006 (TW) ..... 95147542 A

(51) Int. Cl.
*G09G 5/10* (2006.01)

(52) U.S. Cl. ..... 345/690

(58) Field of Classification Search ..... None
See application file for complete search history.

(56) References Cited

U.S. PATENT DOCUMENTS 6,043,797 A 3/2000 Clifton et al.

*Primary Examiner* — Tammy Pham
(74) *Attorney, Agent, or Firm* — Bacon & Thomas, PLLC

(57) ABSTRACT

A method for rapidly generating the gray-level versus brightness curve of a display includes the step of obtaining a portion of the gray-level values and their corresponding brightness values. These values are then used in a mathematical formula to find variables to obtain the gray-level versus brightness curve.

18 Claims, 4 Drawing Sheets

METHOD AND DEVICE OF RAPIDLY GENERATING A GRAY-LEVEL VERSUS BRIGHTNESS CURVE OF A DISPLAY

BACKGROUND OF THE INVENTION

1. Field of the Invention

The present invention relates to a method and device of rapidly generating a gray-level versus brightness curve of a display.

2. Description of the Related Art

A gray-level versus brightness curve of a display is a curve of the relationship between different gray-level values and their corresponding brightness values. The gray-level value may be assigned to the x axis, while the brightness value may be assigned to the y axis; the resulting curve is called the "gray-level versus brightness curve". As the gray-level versus brightness curve is approximately equal to the mathematical gamma curve (Y=X^r, γ curve, or gamma curve), the gray-level versus brightness curve may also be called a gamma curve.

Different displays have different gray-level versus brightness curves. As a result, to provide consistently high product qualities for displays, the gray-level versus brightness curve of each display must be measured. By obtaining the gray-level versus brightness curve of the display, the manufacturer learns of the characteristics of the display, which may be used to further adjust the color settings of the display.

In a prior art technology, entitled "SYSTEM AND METHOD FOR PANEL DISPLAY TELEVISION ADJUSTMENT" (JP patent No. 2005057543, U.S. Pat. No. 6,043,797, TW patent No. 00583624), a system to measure the brightness of a TV is used to perform γ compensation correction for the TV.

The measuring method of the system utilizes a computer (a PC) to consecutively send gray-level signals to the display, a light sensor obtains the brightness-related data from the panel display, and sends all of the data back to the computer for processing to obtain a voltage-brightness curve (voltage as a value suitably corresponds to brightness for the distribution curve) of the panel display. After a graphic generator sends graphic signals to the display, the light sensor measures and sends the data to the computer; this cycle requires one second. To obtain 8 bits of red, green and blue, the three primary colors, and gray values for a continuous gray-level versus brightness curve, which gray (or white) may be considered another primary color, requires 1 (sec)×256 (gray-level values)×4 (primary colors), which is about 17 minutes. Since each work station on the production line has a short period of time to work, if the y compensation correction procedure for the panel display is performed on the production line, a significant cost in terms of time will be imposed by the measurement, which is a reason why γ compensation correction for the panel displays is difficult to perform on the production line.

Therefore, it is desirable to provide a method and device of rapidly generating a gray-level versus brightness curve of a display to mitigate and/or obviate the aforementioned problems.

SUMMARY OF THE INVENTION

A main objective of the present invention is to provide a method of accelerating an image processing procedure for a digital image capturing device.

The method of the present invention obtains partial gray-level value and corresponding measured brightness value of the display and inputs them into the mathematic equation developed by the present invention to establish a gray-level versus brightness curve of the display. Since the present invention only needs partial gray-level value corresponding measured brightness value, the measuring time is reduced and is suitable for the production line.

The method of the present invention includes:

step A: obtaining n sets of ($t_j$, $Y_j$) values, wherein:

j=1~n, 4≦n≦30;

$t_j$ is the jth gray-level value;

$Y_j$ is a corresponding measured brightness value of the jth gray-level value ($t_j$) displayed on the display;

step B: inputting the n sets of ($t_j$, $Y_j$) values into at least one mathematical formula, wherein the at least one mathematical formula comprises a first mathematical formula:

$$Y_j = \frac{L_{\max}}{(1 + e^{a - f(t_j)})}$$

wherein:

$L_{max}$ is the maximum brightness of the gray-level versus brightness curve of the display;

a is a variable;

e is an exponent;

f(t) is a function of t, wherein f(t) comprises a plurality of variables; and step C: inputting all variable values obtained from step B into the first mathematical formula to represent a gray-level versus brightness curve.

According to an embodiment of the present invention, $$f(t_j) = \left[\sum_{j=1}^{n-k} c_j * t_{\max} * \left(\frac{t}{t_{\max}}\right)^{r_j}\right];$$

or $$f(t_j) = b \times \left[\sum_{j=1}^{n-k} c_j * t_{\max} * \left(\frac{t}{t_{\max}}\right)^{r_j}\right];$$

wherein b, $c_j$ is a variable;

$r_j$ is a parameter;

$t_{max}$ is a maximum gray-level value; and

0≦k≦2.

According to another embodiment of the present invention, the method further comprises a second mathematic formula:

$$\sum_{j=1}^{n-k} c_j = M;$$

wherein M is a parameter.

The present invention further includes a device for searching gray-level versus brightness curve for a color display, the device includes:

a signal generator for generating a gray-level diagram of n different gray-level values for input into the color display, wherein the n different gray-level values are defined as $t_j$, j=1~n, and 4≦n≦30;

a light sensor for capturing the gray-level diagram displayed by the color display;

a color analyzer connected to the light sensor to obtain the image on the color display and measuring a corresponding n brightness values for each gray-level diagram, wherein the n brightness values are defined as $Y_j$, j=1~n, and $4 \leqq n \leqq 30$;

a computer connected to the color analyzer to obtain the color information of the color display, the computer comprising a processor and a memory; the memory storing a computer software program executable by the processor; wherein the computer software program comprises a algorithmic program code for a first mathematical formula; the first mathematical formula being:

$$Y_j = \frac{L_{\max}}{(1 + e^{a - f(tj)})}$$

wherein:

$L_{max}$ is the maximum brightness of the gray-level versus brightness curve of the display;

a is a variable;

e is an exponent;

f(t) is a function of t, wherein f(t) comprises a plurality of variables; and the processor executes the computer software program to obtain the value of each variable to represent the gray-level versus brightness curve by the first mathematical formula.

According to another embodiment, a second mathematic formula is utilized:

$$\sum_{j=1}^{n-k} c_j = M$$

wherein M is a parameter.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
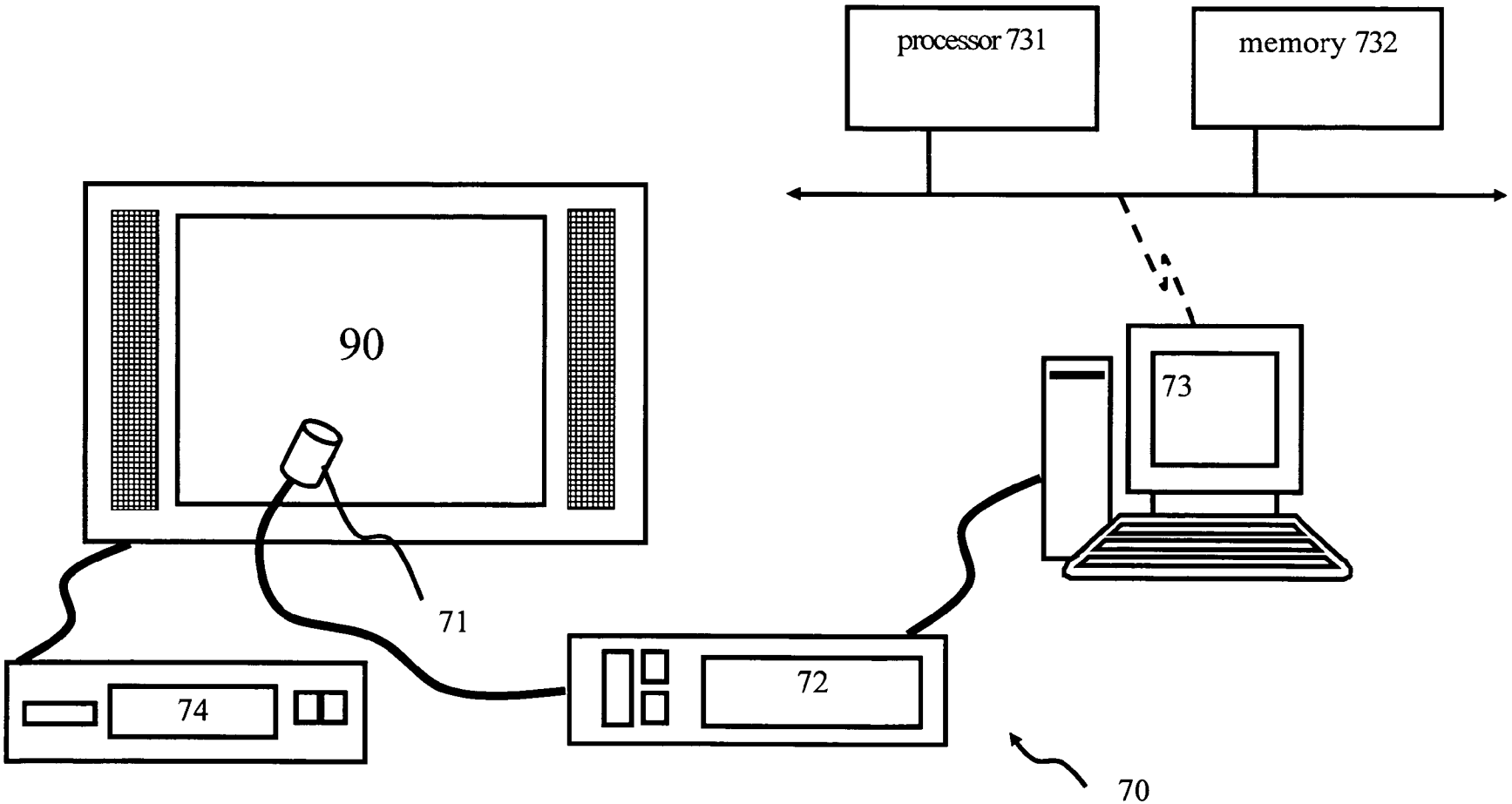
FIG. 1 is a drawing showing the utilization of a computer, light sensor, color analyzer and signal generator to search a gray-level versus brightness curve according to the present invention.

Please refer to FIG. 1. FIG. 1 is a drawing of a device for searching a gray-level versus brightness curve according to the present invention. A device for obtaining a gray-level versus brightness curve 70 comprises a light sensor 71, a color analyzer 72, a computer 73 and a signal generator 74. The signal generator 74 is used for generating specific gray-level diagrams for input into the color display 90; the light sensor 71 is used for capturing the image presented on the color display 90, and the color analyzer 72 measures the color information from the color display 90 (such as the color temperature of each gray-level, as well as brightness and chromaticity) and sends the information to the computer 73 for recording.

According to the prior art technology, the signal generator 74 generates 0 to 255 gray-level image values for each color (red, green, blue and white), and the computer 73 needs only to record the information to obtain the gray-level versus brightness curve without any special operations.

But to rapidly obtain the gray-level versus brightness curve, the signal generator 74 of the present invention only generates a partial gray-level diagram (for example, 5 gray-level diagrams can be the gray-level diagrams for red, green, blue and white; the signal generator 74 may generate one gray-level diagram at once or a plurality of gray-level diagrams at once). The color analyzer 72 measures the corresponding brightness of these gray-level diagrams, and the computer 73 calculates the gray-level versus brightness curve of the color display 90 according to the 5 sets of gray-level values and brightness values.

Figure 2:
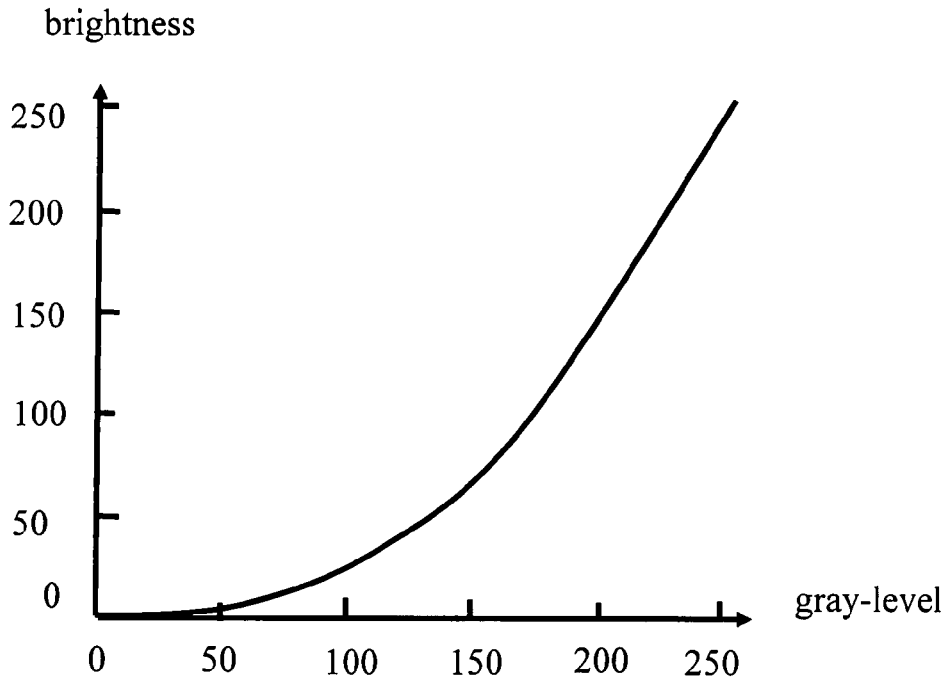
FIG. 2 is a drawing of a typical mathematical gamma-curve.
Figure 3:
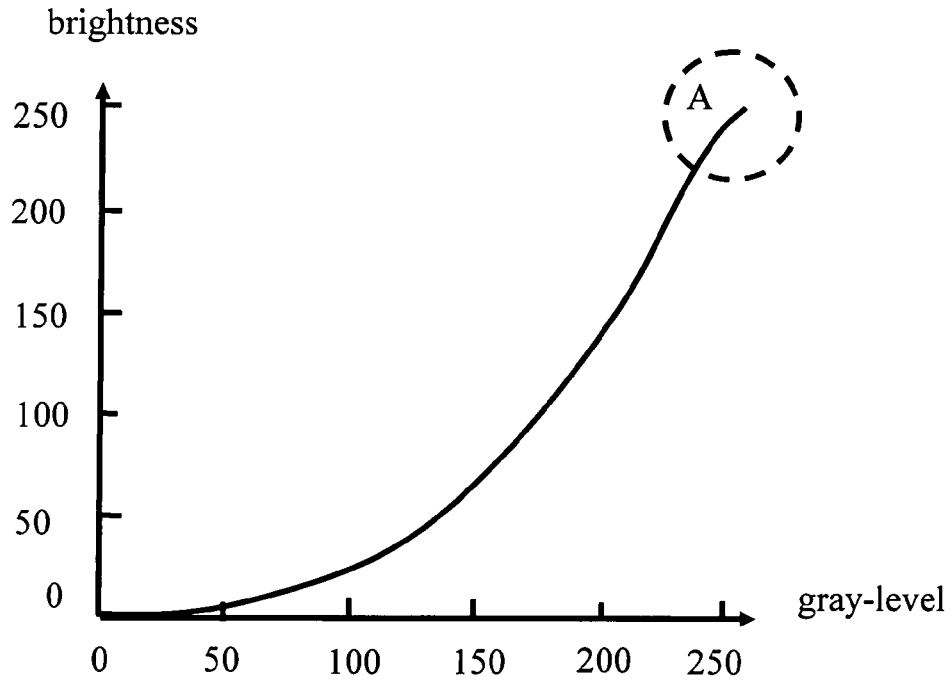
FIG. 3 is a drawing of a gray-level versus brightness curve of a typical display.

A typical gamma-curve should be substantially identical to the gray-level versus brightness curve for the display shown in FIG. 2. However, the actual gray-level versus brightness curve for the display is partly different from the gamma-curve. Saturation as shown in a dashed-lined area A depicted in FIG. 3 may occur at high value levels. Therefore, the gamma-curve may not represent the actual gray-level versus brightness curve of the display.

Figure 4:
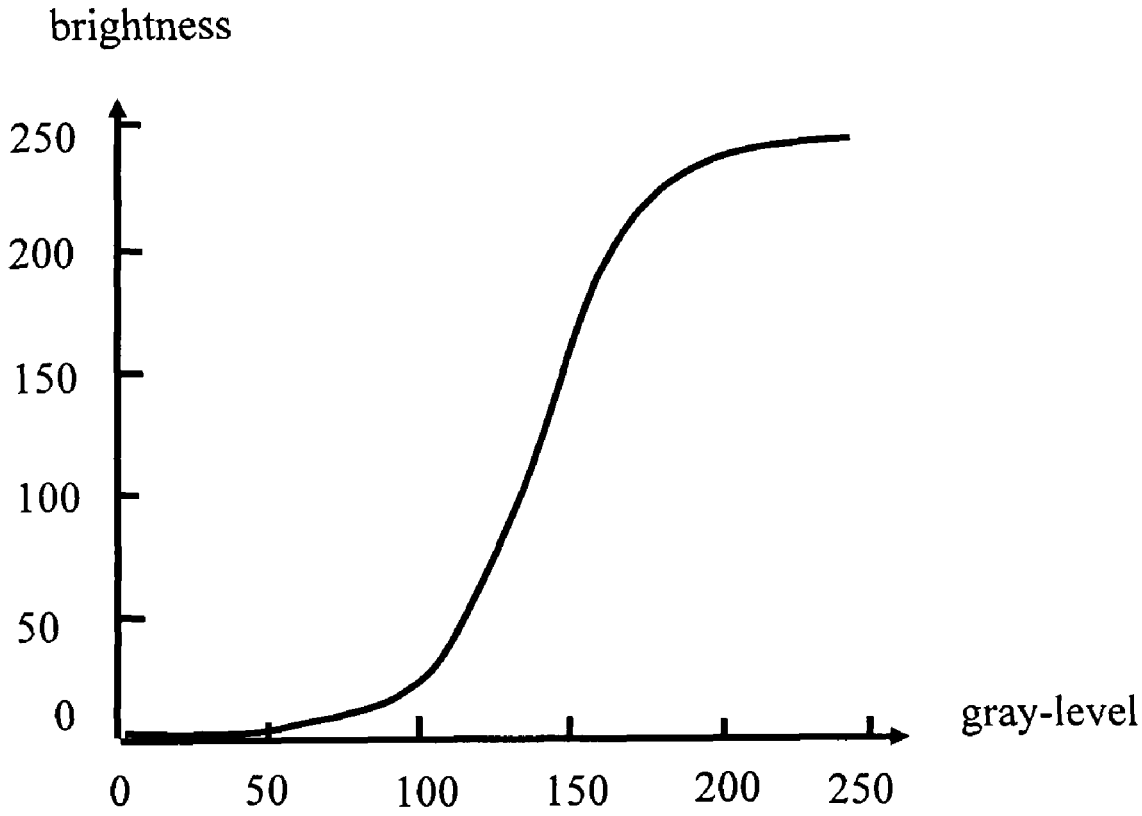
FIG. 4 is a drawing of a typical mathematical S-curve.

But, if an S-curve is utilized, as shown in FIG. 4, a mathematical formula, as shown in the following equation 1, may be used to correct the saturation of the gamma-curve at high value levels, wherein $L_{max}$ is a maximum brightness value of the gray-level versus brightness curve of the display;

$$Y = \frac{L_{\max}}{1 + e^{a - bt}} \qquad \text{Eqn. (1)}$$

wherein t is a gray-level value; Y is a brightness value; a and b are parameters; and e is an exponent.

However, the S-curve may not correctly represent the gray-level versus brightness curve at low level gray values.

Figure 5:
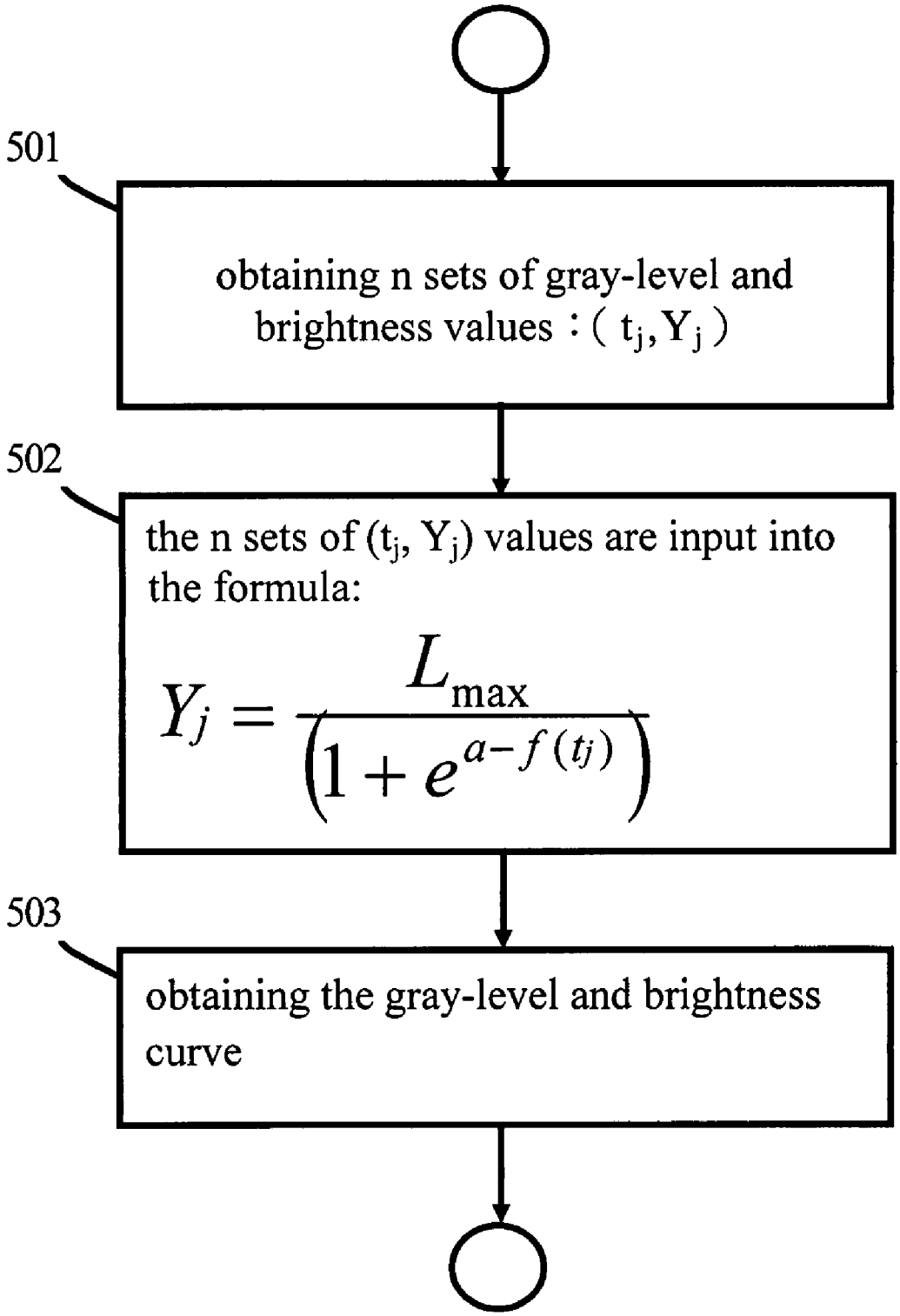
FIG. 5 is a flowchart for obtaining a gray-level versus brightness curve.

Please refer to FIG. 5. FIG. 5 is a flowchart for obtaining the gray-level versus brightness curve.

Step 501:

Obtaining n sets of ($t_j$, $Y_j$) values, wherein:

j=1~n, $4 \leqq n \leqq 30$;

$t_j$ is the jth gray-level value (the jth gray-level value generated by the signal generator 74 is $t_j$);

$Y_j$ is a corresponding measured brightness value of the jth gray-level value ($t_j$) displayed on the display 90.

The signal generator 74 only generates partial gray-level image diagrams to rapidly obtain the gray-level versus brightness curve. In the prior art technology, n is 256 (assuming the gray-level values may be represented as 8 bit values); in the present invention, n is at least 4; of course, the larger n is, the more accurate the curve may be. However, in order to rapidly obtain the gray-level versus brightness curve, the maximum value for n is preferably 30.

Step 502:

The n sets of ($t_j$, $Y_j$) values are input into the above-mentioned mathematical formula. Since the above-mentioned mathematical equations have many different variations, the following equation 2 is the general formula for the first mathematic equation.

$$Y_j = \frac{L_{\max}}{(1 + e^{a-f(tj)})} \quad \text{Eqn. (2)}$$

wherein:

$L_{max}$ is a maximum brightness of the gray-level versus brightness curve of the display;

A is a variable; e is an exponent;

And $f(t_j)$ is a function of $t_j$.

First Embodiment

According to a first embodiment, $f(t_j)$ is provided by the following Eqn. 3:

$$f(t_j) = b \times \left[\sum_{j=1}^{n-1} c_j * t_{\max} * \left(\frac{tj}{t_{\max}}\right)^{r_j}\right] \quad \text{Eqn. (3)}$$

In other words, the first mathematic equation becomes equation 4:

$$Y_j = \frac{L_{\max}}{\left\{1 + e^{a-b\left[\sum_{j=1}^{n-k} c_j * t_{\max} * \left(\frac{tj}{t_{\max}}\right)^{r_j}\right]}\right\}} \quad \text{Eqn. (4)}$$

wherein k=1, and b, $c_j$ are variables;

$r_j$ is a parameter; and $t_{max}$ is a maximum gray-level value (such as 255).

The first embodiment also employs a second mathematical formula, which is shown in the following equation:

$$\sum_{j=1}^{n-k} c_j = M \quad \text{Eqn. (5)}$$

wherein M is a parameter, such as M=1.

For example, $t_{max}$=255, $L_{max}$=255, n=5, M=1, if $r_1$=1, $r_2$=30, $r_3$=0.18, $r_4$=10, and 5 sets of measured corresponding brightness values of the gray-level values ($t_j$, $Y_j$, j=1~5) are (40, 1), (140, 50), (190, 135), (220, 170), and (254, 254). These 5 sets of measured values are input into Eqn. 4 (a first mathematic formula) and Eqn. 5 (a second mathematic formula) to obtain the following 6 variable values: a=18.297, b=−0.095, $c_1$=0.07826, $c_2$=0.19338, $c_3$=0.72836, $c_4$=0.01995. As 5 sets of measured values input into Eqn. 4 can provide five conditions, and as Eqn. 5 is a condition itself, there are thus six conditions for six variable values.

Second Embodiment

A primary difference between the first embodiment and the second embodiment is that there is no need for Eqn. 5 in the second embodiment; therefore, there will reduce one condition, which results that the number of variable reduces one.

The first mathematic formula is then changed to Eqn. 6:

$$Y_j = \frac{L_{\max}}{\left\{1 + e^{a-b\left[\sum_{j=1}^{n-k} c_j * t_{\max} * \left(\frac{tj}{t_{\max}}\right)^{r_j}\right]}\right\}} \quad \text{Eqn. (6)}$$

wherein k=2.

If n=5, only the variable $C_1$~$C_3$ are needed, and not variable $C_4$. Therefore, the number of variable reduces one.

Third Embodiment

A main difference between the first embodiment and the third embodiment is that $f(t_j)$ is changed to the following Eqn. 7:

$$f(t_j) = \left[\sum_{j=1}^{n-k} c_j * t_{\max} * \left(\frac{tj}{t_{\max}}\right)^{r_j}\right] \quad \text{Eqn. (7)}$$

wherein k=1.

Since there is no variable b, there is no need for Eqn. 5.

Fourth Embodiment

A main difference between the first embodiment and the fourth embodiment is that $f(t_j)$ is changed to the following Eqn. 8:

$$f(t_j) = \left[\sum_{j=1}^{n-k} c_j * t_{\max} * \left(\frac{tj}{t_{\max}}\right)^{r_j}\right] \quad (8)$$

wherein k=0.

There is no variable b, but a new variable $C_n$ is added, therefore, Eqn. 5 is still needed.

Step 503:

Obtaining the gray-level versus brightness curve from the calculation performed in step 502.

Since the computer 73 comprises a processor 731 and a memory 732, a software program stored in the memory 732 may perform the calculations needed to obtain a correct gray-level versus brightness curve.

Although the present invention has been explained in relation to its preferred embodiment, it is to be understood that many other possible modifications and variations can be made without departing from the spirit and scope of the invention as hereinafter claimed.

What is claimed is:

1. A method of rapidly generating a gray-level versus brightness curve of a display by obtaining a portion of gray-level values and corresponding brightness values of the display, the method comprising:

step A: obtaining n sets of ($t_j$, $Y_j$) values, wherein:

j=1~n, 4≦n≦30;

$t_j$ is the jth gray-level value;

$Y_j$ is a corresponding measured brightness value of the jth gray-level value ($t_j$) displayed on the display;

step B: inputting the n sets of $(t_j, Y_j)$ values into at least one mathematical formula, wherein the at least one mathematical formula comprises a first mathematical formula:

$$Y_j = \frac{L_{\max}}{(1 + e^{a-f(tj)})}$$

wherein:

$L_{max}$ is the maximum brightness of the gray-level versus brightness curve of the display;

a is a variable;

e is an exponent;

f(t) is a function of t, wherein f(t) comprises a plurality of variables; and step C: inputting all variable values obtained from step B into the first mathematical formula to represent a gray-level versus brightness curve.

2. The method of rapidly generating a gray-level versus brightness curve as claimed in claim 1, wherein:

$$f(t_j) = \left[\sum_{j=1}^{n-k} c_j * t_{\max} * \left(\frac{tj}{t_{\max}}\right)^{r_j}\right];$$

$c_j$ is a variable;

$r_j$ is a parameter;

$t_{max}$ is a maximum gray-level value; and $0 \leqq k \leqq 2$.

3. The method of rapidly generating a gray-level versus brightness curve as claimed in claim 1, wherein:

$$f(t_j) = b \times \left[\sum_{j=1}^{n-k} c_j * t_{\max} * \left(\frac{tj}{t_{\max}}\right)^{r_j}\right];$$

b is a variable;

$c_j$ is a variable;

$r_j$ is a parameter;

$t_{max}$ is a maximum gray-level value; and $0 \leqq k \leqq 2$.

4. The method of rapidly generating a gray-level versus brightness curve as claimed in claim 2, wherein the at least one mathematical formula consists of the first mathematical formula, and k=1.

5. The method of rapidly generating a gray-level versus brightness curve as claimed in claim 3, wherein the at least one mathematical formula consists of the first mathematical formula, and k=2.

6. The method of rapidly generating a gray-level versus brightness curve as claimed in claim 2, wherein k=0, and the at least one mathematical formula further comprises a second mathematical formula:

$$\sum_{j=1}^{n-k} c_j = M;$$

wherein M is a parameter.

7. The method of rapidly generating a gray-level versus brightness curve as claimed in claim 6, wherein M=1.

8. The method of rapidly generating a gray-level versus brightness curve as claimed in claim 3, wherein k=1, and the at least one mathematical formula further comprises a second mathematical formula:

$$\sum_{j=1}^{n-k} c_j = M;$$

wherein M is a parameter.

9. The method of rapidly generating a gray-level versus brightness curve as claimed in claim 8, wherein M=1.

10. A device for obtaining a gray-level versus brightness curve for a color display, the device comprising:

a signal generator for generating a gray-level diagram of n different gray-level values for input into the color display, wherein the n different gray-level values are defined as $t_j$, j=1~n, and $4 \leqq n \leqq 30$;

a light sensor for capturing the gray-level diagram displayed by the color display;

a color analyzer connected to the light sensor to obtain the image on the color display and measuring a corresponding n brightness values for each gray-level diagram, wherein the n brightness values are defined as $Y_j$, j=1~n, and $4 \leqq n \leqq 30$;

a computer connected to the color analyzer to obtain the color information of the color display, the computer comprising a processor and a memory; the memory stored a computer software program executable by the processor; wherein the computer software program comprises a algorithmic program code for a first mathematical formula;

the first mathematical formula being:

$$Y_j = \frac{L_{\max}}{(1 + e^{a-f(tj)})}$$

wherein:

$L_{max}$ is the maximum brightness of the gray-level versus brightness curve of the display;

a is a variable;

e is an exponent;

f(t) is a function of t, wherein f(t) comprises a plurality of variables; and the processor executes the computer software program to obtain the value of each variable to represent the gray-level versus brightness curve by the first mathematical formula.

11. The device for obtaining a gray-level versus brightness curve as claimed in claim 10, wherein:

$$f(t_j) = \left[\sum_{j=1}^{n-k} c_j * t_{\max} * \left(\frac{tj}{t_{\max}}\right)^{r_j}\right];$$

$c_j$ is a variable;

$r_j$ is a parameter;

$t_{max}$ is a maximum gray-level value; and $0 \leqq k \leqq 2$.

12. The device for obtaining a gray-level versus brightness curve as claimed in claim 10, wherein:

$$f(t_j) = b \times \left[ \sum_{j=1}^{n-k} c_j * t_{\max} * \left( \frac{tj}{t_{\max}} \right)^{r_j} \right];$$

b is a variable;

$c_j$ is a variable;

$r_j$ is a parameter;

$t_{max}$ is a maximum gray-level value; and $0 \leqq k \leqq 2$.

13. The device for obtaining a gray-level versus brightness curve as claimed in claim 11, wherein the at least one mathematical formula consists of the first mathematical formula, and k=1.

14. The device for obtaining a gray-level versus brightness curve as claimed in claim 12, wherein the at least one mathematical formula consists of the first mathematical formula, and k=2.

15. The device for obtaining a gray-level versus brightness curve as claimed in claim 11, wherein k=0, and the at least one mathematical formula further comprises a second mathematical formula:

$$\sum_{j=1}^{n-k} c_j = M;$$

wherein M is a parameter.

16. The device for obtaining a gray-level versus brightness curve as claimed in claim 15, wherein M=1.

17. The device for obtaining a gray-level versus brightness curve as claimed in claim 12, wherein k=1, and the at least one mathematical formula further comprises a second mathematical formula:

$$\sum_{j=1}^{n-k} c_j = M;$$

wherein M is a parameter

18. The device for obtaining a gray-level versus brightness curve as claimed in claim 17, wherein M=1.

* * * * *